United States Patent [19]

Kühn et al.

[11] Patent Number: 4,593,153

[45] Date of Patent: Jun. 3, 1986

[54] POWER TRANSMISSION CABLE, SUCH AS LOUDSPEAKER CABLE

[75] Inventors: Volker Kühn; Thomas Kühn, both of Malsch, Fed. Rep. of Germany

[73] Assignee: Audioplan Renate Kuhn, Fed. Rep. of Germany

[21] Appl. No.: 660,240

[22] Filed: Oct. 12, 1984

[30] Foreign Application Priority Data

Oct. 14, 1983 [DE] Fed. Rep. of Germany ..... 3337433

[51] Int. Cl.[4] ..... H01B 11/02; H01B 11/18

[52] U.S. Cl. ..... 174/34; 174/32; 174/36

[58] Field of Search ..... 174/35 SM, 36, 103, 174/105 R, 32, 34, 114 R; 123/633; 307/91; 333/1, 236, 243; 339/148, 177 R

[56] References Cited

U.S. PATENT DOCUMENTS

| | | | |
|---|---|---|---|
| 286,963 | 10/1883 | Reed | 174/105 R |
| 942,332 | 12/1909 | Kitsee | 174/105 R |
| 1,610,980 | 12/1926 | Silberman | 174/105 R |
| 3,215,768 | 11/1965 | Murphy | 174/36 |
| 3,594,491 | 7/1971 | Zeidlhack | 174/36 |
| 4,371,745 | 2/1983 | Sakashita | 174/36 X |
| 4,388,486 | 6/1983 | Nakatsuka | 174/34 |

FOREIGN PATENT DOCUMENTS

| | | | |
|---|---|---|---|
| 236732 | 10/1959 | Australia | 174/36 |
| 211486 | 2/1908 | Fed. Rep. of Germany | 174/103 |

*Primary Examiner*—A. T. Grimley
*Assistant Examiner*—Morris H. Nimmo
*Attorney, Agent, or Firm*—Antonelli, Terry & Wands

[57] ABSTRACT

In the case of power transmission cables, such as loudspeaker cables for connecting a loudspeaker to an amplifier, the problem occurs that on ensuring a high power transmission, it is simultaneously necessary to transmit information, e.g. also modulated musical information in an optimum undistorted and undisturbed manner from the amplifier to the loudspeaker. For solving this problem, it is proposed to construct one conductor of such a loudspeaker cable from an internal partial conductor and an external partial conductor surrounding the former and separated therefrom by a dielectric, said internal and external partial conductors being interconnected at the connecting elements.

6 Claims, 3 Drawing Figures

POWER TRANSMISSION CABLE, SUCH AS LOUDSPEAKER CABLE

BACKGROUND OF THE INVENTION

The present invention relates to a power transmission cable, such as a loudspeaker cable for connecting a loudspeaker to an amplifier, with at least one conductor and connecting elements.

Generally, twin-core cables are used as the connecting cable between e.g. an amplifier and a loudspeaker, the two cores or conductors running parallel alongside one another. Such a transmission cable may have to transmit a considerable amount of power. In addition, the problem arises that, in addition to the power transmission, it must also be able to transmit simultaneously in an undistorted and undisturbed form the information which is to be transmitted, e.g. modulated-on music. The latter can scarcely be ensured in the case of conventional loudspeaker cables, because on the one hand the two conductors reciprocally influence one another and on the other hand they are completely exposed to external interference. Thus, music transmitted e.g. by such a cable and played back by the loudspeaker can be distorted. Hitherto, such distortion has been generally attributed to the loudspeaker. However, the present inventors have found that these deficiencies are due to a considerable extent to the conventional loudspeaker cables.

SUMMARY OF THE INVENTION

The problem of the present invention is to provide a cable of the aforementioned type, which eliminates the aforementioned deficiencies and, in particular whilst permitting a high power transmission, enables modulated-on information to be transmitted in an optimum undistorted manner.

According to the invention, this problem is solved in the case of a power transmission cable in that a conductor comprises an internal partial conductor and at least one external coaxial partial conductor surrounding the internal partial conductor and separated therefrom and from one another by a dielectric, the internal and at least one external partial conductor being electrically interconnected at the connecting elements.

As a result of the cross-sectionally annular conductor construction of an inner and outer partial conductor, there is an improvement to the transmission characteristics with respect to quantity and quality, namely power and lack of distortion. External magnetic field influences, such as interference and influences of the normally present return conductor on the inner partial conductor are substantially eliminated by the magnetic field shielding or screening of the external partial conductor and consequently an unhindered pulse transmission is ensured, because the gap between the two individual conductors, which is optionally filled by a dielectric is kept magnetic field-free. Thus, the signal component is transmitted in a completely undisturbed manner on the internal conductor whilst simultaneously power transmission is ensured by the subdividing into two single conductors, one of which is an external annular conductor. One conductor can optionally comprise several individual stranded wires or can be in the form of a waveguide surrounding a dielectric. According to a preferred embodiment, the external conductor comprises two layers of individual stranded wires. This leads to such an improvement in the transmission characteristics that at least the external annular conductor is substantially flat and is not compact, so that there are reduced disturbances of the individual fields compared with a conventional compact conductor construction, whilst simultaneously the cross-section or surface area of the external conductor is large and consequently, as stated, ensures a high power transmission.

According to a further development, the external partial conductor is constructed in the form of a mesh. According to a further development, the outward and return conductors conventionally present in a loudspeaker cable are twisted or stranded, in order to further eliminate such inductive influences.

The aforementioned advantages with regards to the power transmission and quality of the information transmission result from the combination of a protected internal conductor and the efficiency of the external conductor.

BRIEF DESCRIPTION OF THE DRAWINGS

The invention is described in greater detail hereinafter relative to an embodiment of the cable according to the invention and relative to the attached drawings, wherein show.

DETAILED DESCRIPTION OF THE INVENTION

Figure 1:
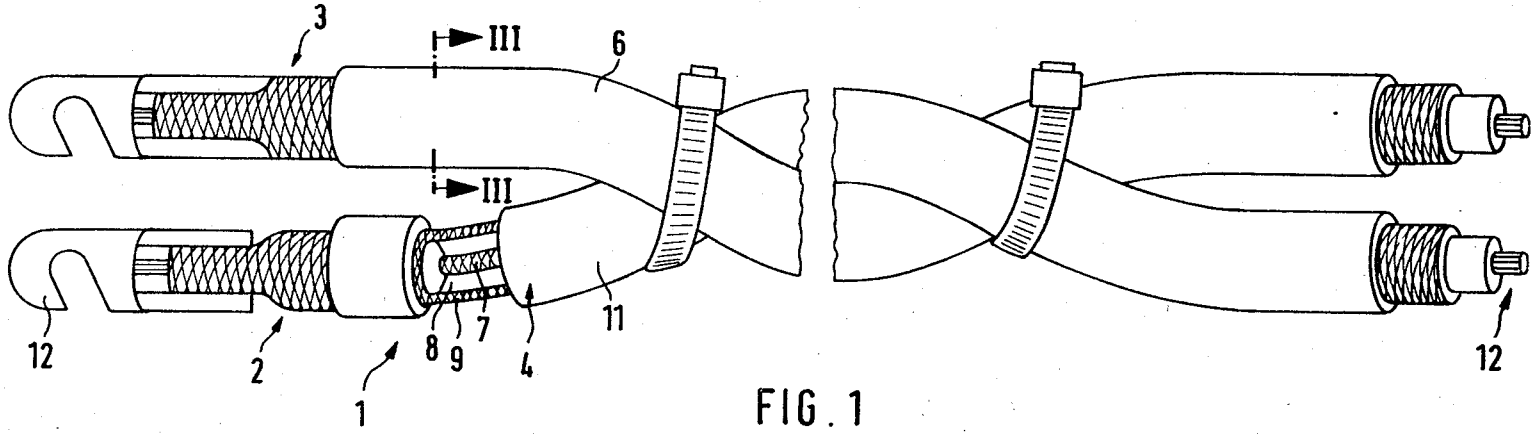
FIG. 1 an embodiment of the cable according to the invention in side view, with in part broken away parts.
Figure 3:
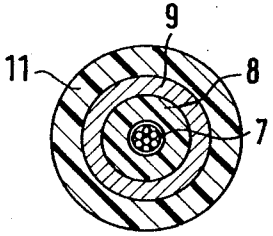
FIG. 3 a section along III—III of FIG. 1.
Figure 2:
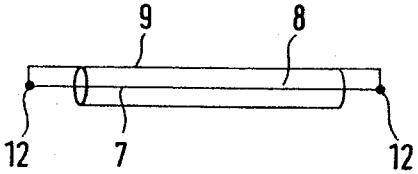
FIG. 2 a diagrammatic view of a single conductor according to FIG. 1.

The cable 1 according to the invention in the embodiment of FIG. 1 comprises two single conductors, namely an outward conductor 2 and a return conductor 3, which are in each case constructed as individual cables 4, 6, which are stranded or twisted together.

The construction of an individual cable will be explained relative to individual cable 4. Cable 4 has a central, internal partial conductor or internal conductor 7, which is surrounded by an insulating dielectric 8. An external partial conductor, external conductor or annular conductor 9 is arranged coaxially to and surrounds internal conductor 7 and dielectric 8. The complete arrangement 7 to 9 is surrounded by an external insulation 11. The internal and external partial conductors 7, 9 are not electrically separated or isolated from one another and are instead electrically interconnected in the vicinity of connecting element 12. Thus, current can flow both through internal conductor 7 and external conductor 9, so that power is transmitted through both partial conductors 7 and 9. Moreover, the information to be transmitted, e.g. the modulated-on musical information, particularly on the internal conductor is not disturbed and is in no way impaired, which ensures both an optimum information and power transmission, as is required in the case of such loudspeaker cables.

The features of the invention disclosed in the above description, the drawings and in the claims can be essential for the realisation of the invention, either singly, or in random combinations.

What is claimed is:

1. A power transmission cable, such as a loudspeaker cable for connecting a loudspeaker to an amplifier, with two conductors and associated connecting elements, wherein each conductor comprises an internal partial conductor and at least one external coaxial partial conductor surrounding the internal partial conductor, the internal partial conductor and the at least one external coaxial partial conductor being electrically insulated from one another over the length of the cable, the internal partial conductor and the at least one external coaxial partial conductor being electrically interconnected at their respective ends at the vicinity of the associated connecting elements.

2. A cable according to claim 1, wherein the at least one external coaxial partial conductor comprises two layers of individual stranded wires.

3. A cable according to claims 1 or 2, wherein the at least one external coaxial partial conductor is constructed in the form of a mesh.

4. A cable according to claim 1, wherein the internal partial conductor comprises individual stranded wires.

5. A cable according to claim 1, wherein the two conductors, each comprising the at least one external coaxial partial and internal partial conductors, are stranded or twisted together with insulation means therebetween.

6. A cable according to claim 2, wherein the stranded wires of the two conductors are silver-coated.

* * * * *